US007225486B2

(12) United States Patent
Jackson, III

(10) Patent No.: US 7,225,486 B2
(45) Date of Patent: Jun. 5, 2007

(54) THERAPEUTIC SEAT CUSHION

(76) Inventor: Avery M. Jackson, III, 8038 Pepperwood Dr., Grand Blanc, MI (US) 48439

( * ) Notice: Subject to any disclaimer, the term of this patent is extended or adjusted under 35 U.S.C. 154(b) by 0 days.

(21) Appl. No.: 11/208,677

(22) Filed: Aug. 22, 2005

(65) Prior Publication Data

US 2006/0150338 A1 Jul. 13, 2006

Related U.S. Application Data

(63) Continuation of application No. 11/032,371, filed on Jan. 10, 2005.

(51) Int. Cl.
*A47C 20/00* (2006.01)

(52) U.S. Cl. ..... 5/654; 5/653

(58) Field of Classification Search ..... 5/655.3, 5/654, 63, 713
See application file for complete search history.

(56) References Cited

U.S. PATENT DOCUMENTS 3,760,801 A * 9/1973 Borgeas ..... 601/149
3,872,525 A * 3/1975 Lea et al. ..... 5/671
4,054,960 A 10/1977 Pettit
4,660,238 A * 4/1987 Jay ..... 5/654
4,759,543 A * 7/1988 Feldman ..... 482/148
4,761,843 A * 8/1988 Jay ..... 5/654
5,029,939 A * 7/1991 Smith et al. ..... 297/284.1
5,163,196 A * 11/1992 Graebe et al. ..... 5/654
5,193,237 A * 3/1993 Holdredge ..... 5/654
5,245,719 A * 9/1993 Ott ..... 5/632
5,363,524 A 11/1994 Lang
5,379,471 A * 1/1995 Holdredge ..... 5/655.3
5,412,822 A * 5/1995 Kelly ..... 5/655.3
5,613,257 A * 3/1997 Graebe ..... 5/654
5,771,514 A * 6/1998 Wilhoit ..... 5/644
5,785,669 A * 7/1998 Proctor et al. ..... 601/148
5,839,140 A * 11/1998 Wilkerson ..... 5/654
5,845,352 A * 12/1998 Matsler et al. ..... 5/654
5,881,407 A * 3/1999 Chu Pt ..... 5/654
5,963,997 A * 10/1999 Hagopian ..... 5/654
6,036,271 A * 3/2000 Wilkinson et al. ..... 297/452.41
6,065,166 A * 5/2000 Sharrock et al. ..... 5/630
6,135,550 A * 10/2000 Tucho ..... 297/199
6,199,647 B1 * 3/2001 Schaffner et al. ..... 180/65.1
6,241,320 B1 * 6/2001 Chew et al. ..... 297/452.26
6,327,724 B1 * 12/2001 Sharrock et al. ..... 5/630

(Continued)

*Primary Examiner*—David Bagnell
*Assistant Examiner*—Jonathan Liu
(74) *Attorney, Agent, or Firm*—Dennis H. Lambert

(57) ABSTRACT

A therapeutic seat cushion for supporting a person remaining in a sitting position for a prolonged period of time, wherein the cushion is a generally rectangular body having a hollow interior with a plurality of generally radially extending partitions extending across the interior of the body, dividing it into a plurality of individual chambers spaced sequentially around the body. Apparatus is connected with the chambers to sequentially expand and contract them in an alternating pattern so that some of the chambers are expanded to contact and support the person while other chambers are contracted to relieve the pressure exerted against the person by the other chambers, whereby the formation of pressure sores and other harmful effects are avoided by periodically and temporarily relieving pressure exerted by the chambers against different areas of the person. In one embodiment the cushion is generally toroidally shaped, with a generally T-shaped central opening, and in another embodiment the cushion has a shaped reduced thickness central portion.

14 Claims, 4 Drawing Sheets

U.S. PATENT DOCUMENTS 6,375,209 B1 * 4/2002 Schlangen ..... 280/250.1
6,510,574 B2 1/2003 Sharrock et al.
6,598,250 B1 * 7/2003 Pekar ..... 5/654
6,611,980 B2 * 9/2003 Wempe ..... 5/654
6,625,830 B2 * 9/2003 Lampel ..... 5/653
6,671,911 B1 * 1/2004 Hill et al. ..... 5/713
6,782,573 B2 * 8/2004 Odderson ..... 5/654
6,789,283 B2 * 9/2004 Pirzada ..... 5/713
6,901,617 B2 * 6/2005 Sprouse et al. ..... 5/654
2002/0078507 A1 6/2002 Pearce

* cited by examiner

THERAPEUTIC SEAT CUSHION

RELATED APPLICATIONS

This application is a continuation-in-part of prior co-pending U.S. application Ser. No. 11/032,371, filed Jan. 10, 2005.

FIELD OF THE INVENTION

This invention relates generally to cushions for supporting parts of the human anatomy. In particular, the invention is a therapeutic seat cushion for persons remaining in a sitting position for prolonged periods of time, with means to periodically relieve the pressure exerted on different areas of the person's posterior, thereby improving blood circulation and comfort, stimulating muscles, and preventing or reducing the formation of sores and other harmful effects of prolonged immobility.

DESCRIPTION OF THE PRIOR ART

Inflatable pillows or cushions of various designs and constructions are known in the art for various purposes. Some of these devices have multiple chambers that are constructed to provide more or less support than adjacent chambers, e.g., some chambers are larger than others. In other prior art devices multiple separate chambers can be inflated to different pressures to produce a desired configuration or extent of support by different areas of the cushion. These prior art devices are intended for one or more of a variety of uses, including, for example, exercise therapy, support of the head and neck during sleep, and support during surgical procedures. Some devices are constructed to prevent tissue and/or nerve damage caused by prolonged pressure on localized areas of the body, especially during and after long surgical procedures.

Examples of prior art devices are disclosed in U.S. Pat. Nos. 3,760,801, 4,054,960, 4,759,543, 5,245,719, 5,412,822, 6,065,166 and 6,510,574, discussed briefly below.

U.S. Pat. No. 3,760,801 discloses a full-body exercise therapy cushion that may be selectively inflated and deflated to alternately elevate and lower portions of the body for stimulating muscles in persons who are immobile for prolonged periods of time.

U.S. Pat. No. 4,054,960 discloses a body support cushion that has recesses or cavities therein to relieve pressure on portions of a person's body, e.g., the abdomen of a pregnant woman.

U.S. Pat. No. 4,759,543 discloses a passive exercise cushion for placement against the backrest of a chair and constructed to alleviate or prevent back pain by exerting a forwardly directed force on the back of the person using the cushion, thereby passively maintaining bodily equilibrium by causing counterbalancing contraction of the muscles.

U.S. Pat. No. 5,245,719 discloses a torso support cushion having elongate parallel chambers defining an elongate recessed area or tunnel between them in which additional supporting members can be placed for adjustability of the cushion in dependence upon the requirements of the user.

U.S. Pat. No. 5,412,822 discloses several embodiments of inflatable cushions having multiple chambers that are overlapped with one another and that can be inflated to desired predetermined pressures to accommodate specific situations. The embodiment shown in FIG. 13 can be used as a seat cushion in a chair or wheelchair.

U.S. Pat. No. 6,065,166 discloses a pneumatic support cushion that is intended to maintain a person in a lateral decubitus or lateral inclined position, for support of the flank portion, for example, during surgical procedures, or at rest. In particular, the cushion disclosed in this patent has at least one member suitable for preventing rotation or rolling of the person out of the lateral decubitus position, and a section providing cushioned support above a surface so that the arm and shoulder are relieved of the forces of the body while distributing the body weight on the skin surface. By adjustment of the inflation pressure, the position of the patient may be adjusted. In one embodiment, plural separate chambers may be provided, especially in the weight distributing portion of the cushion, and the inflation pressure or volume of one or more of the chambers can be varied separately or together over time to relieve local pressure on the skin briefly to allow microcirculation to return, or to act as a peristaltic pump to assist in circulation in the supporting tissue. The separate chambers disclosed in this patent are elongate tubular members arranged parallel to one another, thus forming a plurality of parallel systems that will support the person even if one system is punctured during surgery or the like.

U.S. Pat. No. 6,510,574 discloses in FIG. 4 an inflatable cushion for supporting the face of a patient during surgery. The cushion disclosed in this patent is generally U-shaped, with an opening or recessed area in a central portion thereof to provide clearance in the vicinity of the mouth, nose and eyes of the patient.

Although some of the foregoing patents disclose that the extent of inflation of the various cushions or cushion compartments can be increased or decreased, with the exception of U.S. Pat. No. 6,065,166 there is no suggestion of cyclically inflating and deflating the chambers to periodically relieve pressure on different areas of the body to thereby prevent the formation of pressure sores or other damage that might be caused by prolonged unrelieved pressure on those areas. The cushion disclosed in the '166 patent is intended for use with patients lying prone and is constructed to support portions of the torso.

Prolonged immobilization of a person, with the resultant constant pressure on parts of the body, can, at a minimum, lead to discomfort, but can also lead to more serious consequences such as the formation of pressure sores, decubitus ulcers, nerve damage, and/or other problems. Persons confined to a wheelchair, for example, may remain in a generally immobile or undisturbed sitting position for prolonged periods of time, with relatively constant pressure applied to the buttocks. The resulting discomfort and/or formation of sores and the like can be especially acute in those persons who have lost weight and/or muscle mass, since the buttocks (gluteous maximus) may not provide sufficient padding to prevent concentration of pressure on, for example, tissue overlying the coccyx or ischial tuberosity.

Although U.S. Pat. No. 5,412,822 discloses a cushion that can be placed in a wheelchair for a patient to sit on, and therefore undoubtedly would increase comfort, there is no suggestion of any means for cyclically varying the extent of support provided by different areas of the cushion, or of using the power source of the wheelchair itself as a means for inflating and deflating the cushion.

It would be advantageous to have a therapeutic seat support cushion for persons who must remain relatively immobile for prolonged periods of time, especially persons confined to a wheelchair, wherein the seat cushion has a plurality of chambers or sections that can be cyclically inflated and deflated to periodically and temporarily relieve pressure on different areas of the person's buttocks, thereby improving comfort and preventing the formation of pressure sores or other adverse effects on tissue contacting and supported by the cushion. It would be further advantageous to have such a cushion wherein inflation and deflation of the chambers is achieved by use of the power source of the wheelchair itself.

DESCRIPTION OF THE INVENTION

The present invention is a therapeutic seat support cushion that has a plurality of chambers or sections with means for temporarily removing or reducing the support provided by each section to thereby cyclically and temporarily relieve pressure on different areas of a person's buttocks and thighs, thus improving comfort and preventing the formation of pressure sores or other adverse effects on tissue contacted and supported by the cushion.

Cyclically and periodically increasing and decreasing the support provided by the different cushion sections can be achieved by alternately inflating and deflating the sections, or by use of a mechanical device associated with each section. A control apparatus connected with the cushion via suitable means preferably achieves control of this cyclic operation. For instance, if the chambers of the cushion are inflated and deflated with a gaseous or liquid fluid medium, the control apparatus can comprise a system of valves that operate to supply and exhaust pressurized fluid to and from the respective chambers in a timed sequence. The control apparatus can function to simply control the flow of fluid to the cushion from a separate source of pressurized fluid, or it can function to pressurize the fluid as well as to control the flow of the fluid to and from the cushion. Similarly, if mechanical devices are used to expand and contract the different sections of the cushion, the control apparatus can supply electrical energy or the like as necessary. In a preferred embodiment, the power to inflate and deflate the chambers, and control this action, can be derived from the power source for a wheelchair when the cushion is used in or incorporated with a wheelchair or other seat apparatus.

In one embodiment, the cushion is generally torus-shaped, with a generally T-shaped central opening or recessed area, so that most of the weight of the person is supported by the fleshier parts of the buttocks of a person sitting on the cushion, thereby relieving pressure on the tissue overlying the tailbone (coccyx). In a preferred embodiment, the cushion has separate inflatable chambers, and a tube extends from a control apparatus to each chamber to cyclically supply pressurized fluid to the chamber and exhaust fluid therefrom in a timed sequence. A valve and control system such as that disclosed in U.S. Pat. No. 6,065,166, for example, can be employed in the present invention.

The tubes leading from the control apparatus to the cushion preferably are bundled together for neatness and order, with the tubes leading to individual chambers extending around the periphery of the cushion and either enclosed in a sleeve or lying close to the surface of the cushion. The tubes for conveying fluid, or electrical wires for conducting electrical energy when mechanical or electromechanical devices are used to expand and contract the different sections of the cushion, can approach and be connected to the cushion on any side thereof.

In some instances it may be desirable to construct the cushion so that either surface of it can be oriented upwardly. Thus, it would be possible to invert the cushion to place the collapsed or deflated chamber on either side of the cushion. Also, the tubes or wires and the like leading to the cushion could be placed at the back of the cushion, rather than at one side or the front. This would result in location of these tubes in an out-of-the-way position away from the front or sides of a wheelchair, for example, and less likely to get in the way.

The cushion can be made of any suitable material for the intended purpose, including flexible sheets of a polymeric resin such as polyvinyl chloride, or polyurethane, and the like. Further, the cushion can be made disposable or reusable, and can have means associated with it for attaching it to the seat of a wheelchair or the like. For example, Velcro® straps, or hooks, or snaps, or flaps like those employed in U.S. Pat. No. 6,510574, for example, could be provided to maintain the cushion in place during use. Alternatively, the cushion could simply be placed on the supporting surface without any means for attaching it to the surface.

Initially during use, all chambers of the cushion are inflated or expanded. The control apparatus is then operative to alternately and sequentially cyclically deflate selected chambers to periodically relieve pressure on different areas of a person's buttocks, and then reinflate those chambers while others are deflated. The chambers preferably are deflated in pairs, with the deflated chambers being located generally on opposite sides of the buttocks. For example, in one embodiment of the invention the cushion has eight chambers arranged sequentially around its circumference in a clockwise direction, with chamber number one located approximately between the 10 and 12 o'clock positions, chamber number two located approximately between the 12 and 2 o'clock positions, chamber three located approximately between the 2 and 3 o'clock positions, chamber four located approximately between the 3 and 4 o'clock positions, chamber five located approximately between the 4 and 6 o'clock positions, chamber six located approximately between the 6 and 8 o'clock positions, chamber seven located approximately between the 8 and 9 o'clock positions, and chamber eight located approximately between the 9 and 10 o'clock positions. Chambers one and two are first deflated for a set time, e.g., one or two minutes, and then reinflated. Chambers three and eight are next deflated for the set time and then reinflated, followed by deflation and reinflation of chambers four and seven, then chambers five and six, then back to chambers one and three. This cycle is repeated as many times and as often as necessary so that no chamber exerts continuous pressure on an area of the buttocks or thighs for more than about two minutes. It should be understood that although eight chambers are shown and described in the preferred embodiment, a different number could be employed, and a different sequence of deflation and reinflation could be employed so long as alternate inflation and deflation of the chambers functions to temporarily relieve pressure on areas of the body supported by the seat cushion, while the cushion continues to provide balanced support to the patient.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE PREFERRED EMBODIMENTS

Figure 1:
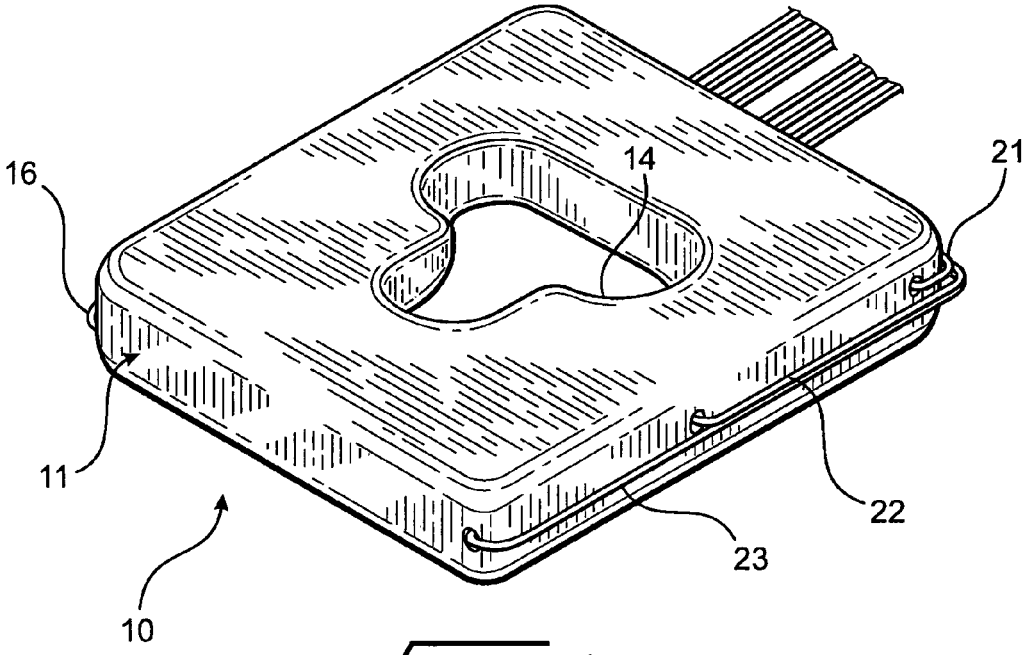
FIG. 1 is a top perspective view of a first embodiment of a cushion according to the invention.

A first embodiment of a cushion according to the invention is indicated at 10 in FIGS. 1–4. The cushion comprises a generally rectangularly shaped body 11 that in this embodiment is torus- or donut-shaped, with an upper surface 12 and a lower surface 13, and a generally T-shaped opening 14 in its center. The toroidally shaped cushion has a width and thickness to support a person sitting on it, with the T-shaped opening 14 resulting in the weight of the person being supported by the relatively fleshier gluteous maximus and relieving pressure generally in the area of the coccyx.

The interior of the torus-shaped cushion is divided by generally radially extending partitions 15 into a plurality of individual sections or chambers 1 through 8 of substantially equal size spaced sequentially around the cushion. In the specific example shown in the drawings, succeeding chambers are arrayed in a clockwise direction, with chamber 1 located approximately in an area between the 10 and 12 o'clock positions, chamber 2 located approximately between the 12 and 2 o'clock positions, chamber 3 located approximately between the 2 and 3 o'clock positions, chamber 4 located approximately between the 3 and 5 o'clock positions, chamber 5 located approximately between the 5 and 6 o'clock positions, chamber 6 located approximately between the 6 and 8 o'clock positions, chamber 7 located approximately between the 8 and 9 o'clock positions, and chamber 8 located approximately between the 9 and 10 o'clock positions.

In the preferred embodiment the cushion is inflated with a fluid such as air or other gas, although a liquid could be used, or the chambers could be expanded and contracted by a mechanical means, not shown. To alternately inflate and deflate the chambers with either pneumatic or hydraulic means, lengths of tubing 16 through 23 are connected between the respective chambers and a suitable control means 24.

Figure 2:
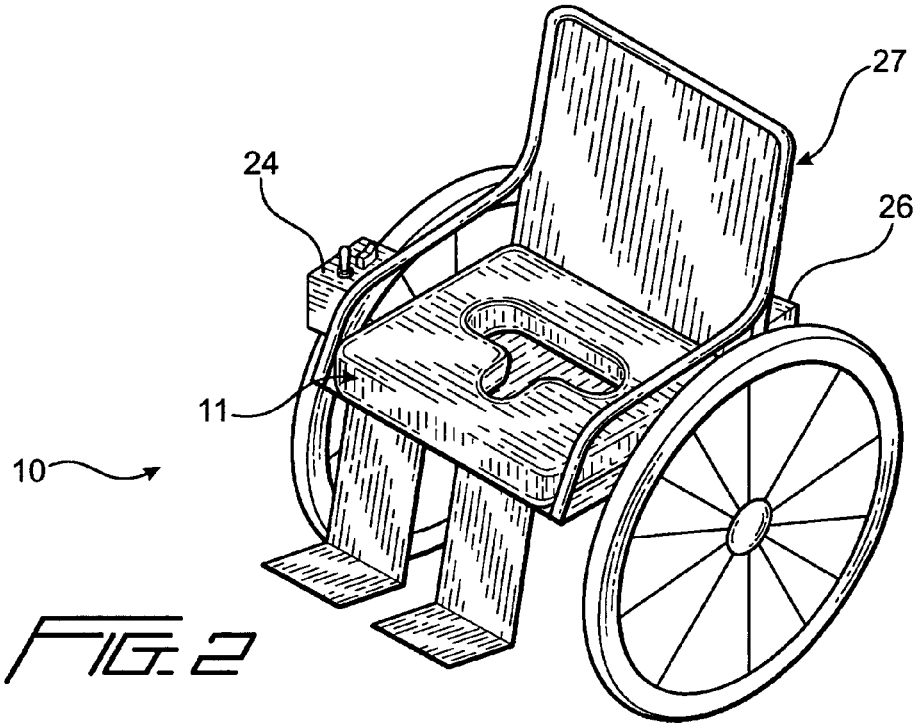
FIG. 2 is a somewhat schematic top perspective view of the cushion of FIG. 1 positioned on a wheelchair.
Figure 3:
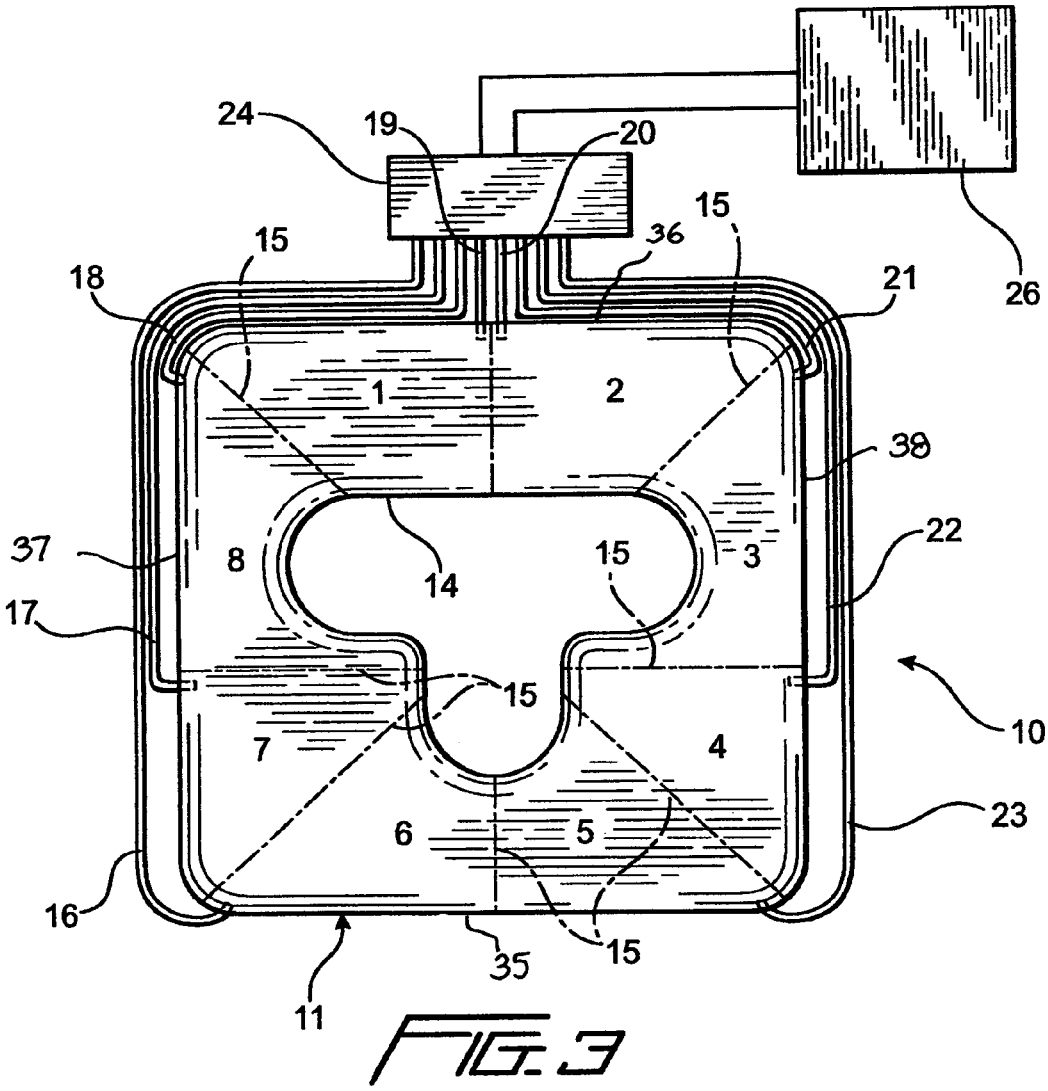
FIG. 3 is a top plan view of the cushion of FIG. 1, with some of the control means attached.
Figure 4:
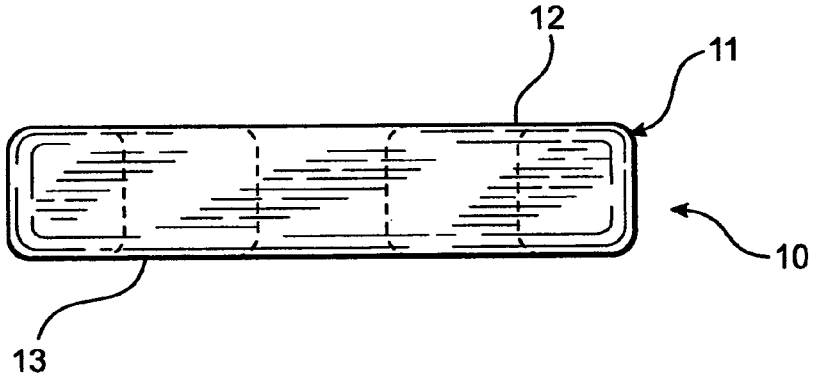
FIG. 4 is a side view in elevation of the cushion of FIG. 1.
Figure 5:
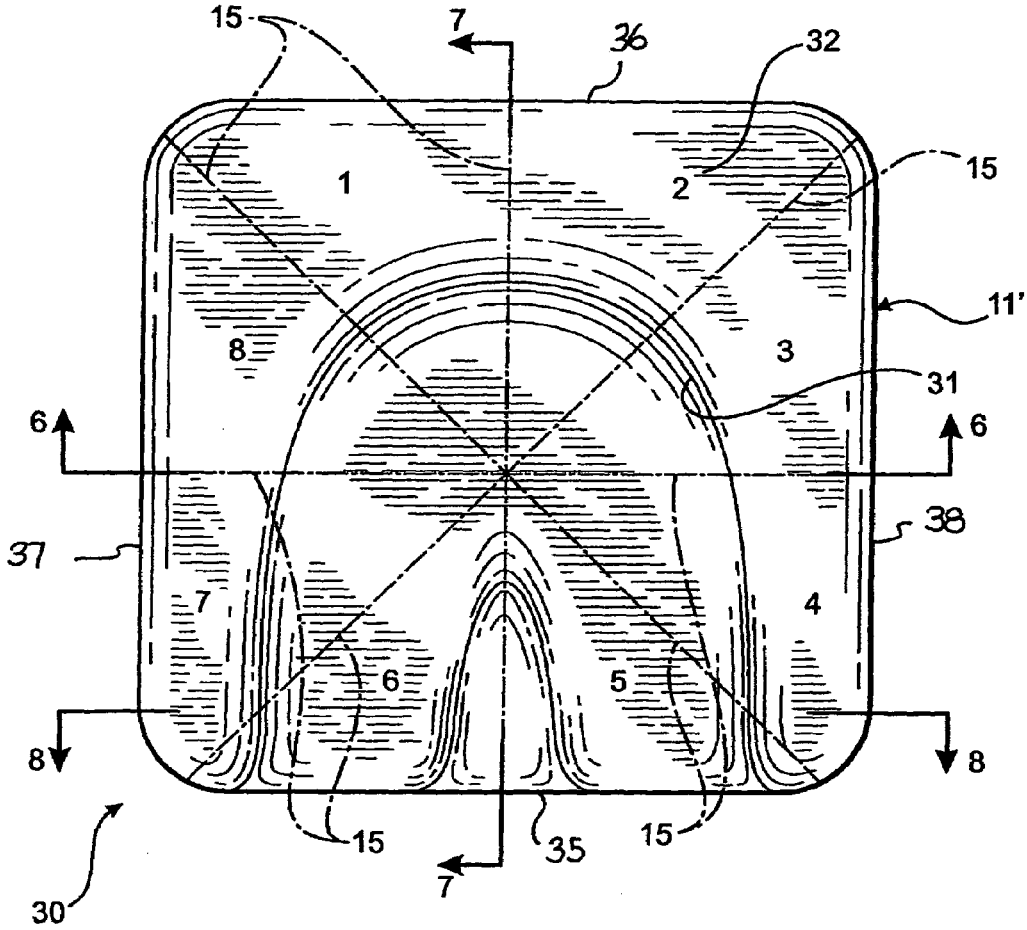
FIG. 5 is a top plan view of a second embodiment of cushion according to the invention.
Figure 6:
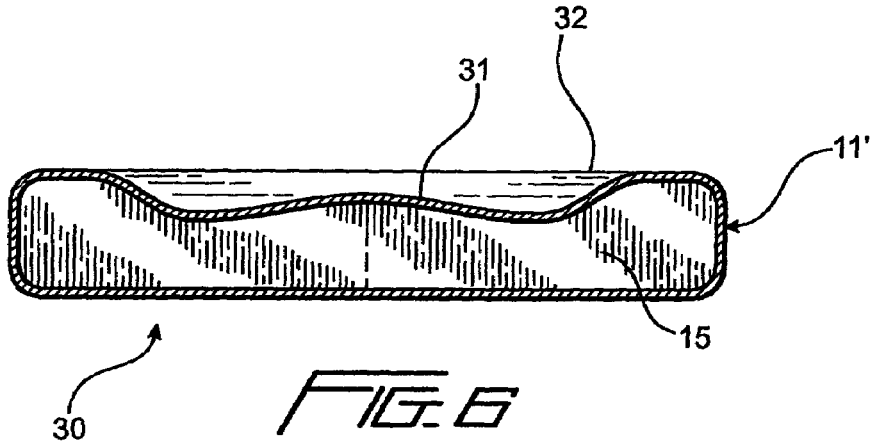
FIG. 6 is a transverse sectional view of the cushion of FIG. 5, taken along line 6—6 in FIG. 5.
Figure 7:
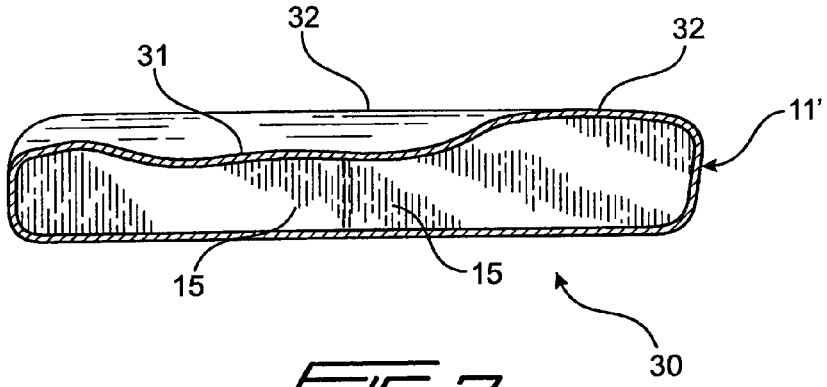
FIG. 7 is a transverse sectional view of the cushion of FIG. 5, taken along line 7—7 in FIG. 5.
Figure 8:
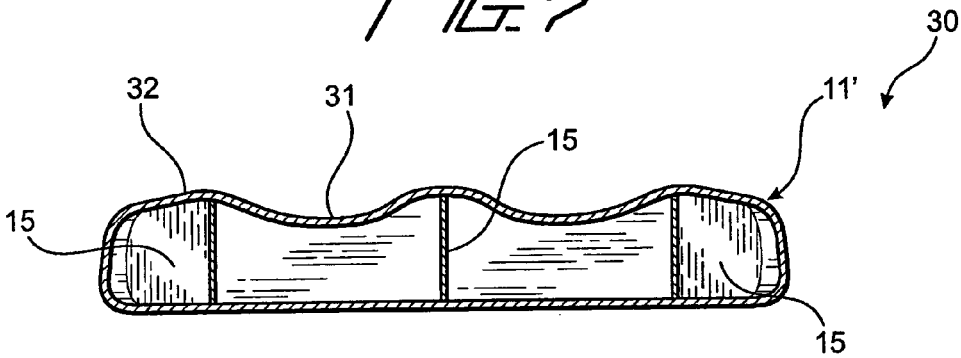
FIG. 8 is a transverse sectional view of the cushion of FIG. 5, taken along line 8—8 in FIG. 5.
Figure 9:
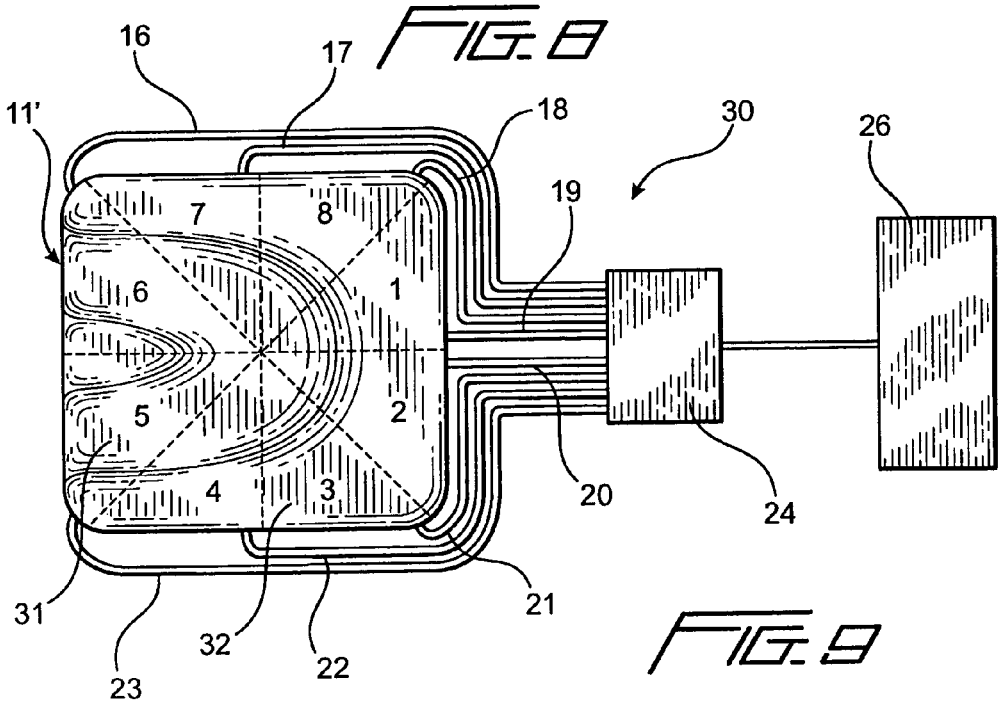
FIG. 9 is a top plan view of the cushion of FIG. 5, with the control means attached.

As shown in FIGS. 2 and 3 the control means 24 may include a compressor or pump device combined with a set of valves of conventional construction, operative to open and close in timed sequence to either supply a pressurized fluid (gas or liquid) to the chambers or exhaust fluid from the chambers. Energy for operating the pump and valves can be derived from the power source 26 of a wheelchair 27 when the cushion is used with a wheelchair as shown in FIG. 2. The lengths of tubing extending between the control means 24 and the cushion can be enclosed in a sheath or sleeve (not shown), if desired, although it is intended that the control means and cushion both will be attached to the wheelchair, or other seat apparatus, on which the patient is supported.

Alternatively, the control means may comprise a set of valves (not shown) connected in the lengths of tubing 16–23 to control flow of fluid to the chambers from a separate source (not shown) of pressurized fluid, and to exhaust fluid from the chambers in predetermined timed sequence. An arrangement of this type is shown in applicant's copending U.S. application Ser. No. 11/032,371, the disclosure of which is incorporated in full herein.

An alternative embodiment is indicated generally at 30 in FIGS. 5–9, wherein the generally rectangularly shaped body 11' has a shaped central section 31 of reduced thickness, rather than the T-shaped opening of the previous embodiment, and is constructed to distribute the weight of the person more uniformly over the entire buttocks, with the peripheral portion 32 carrying a substantial part of the weight. Pressure on the thighs and under the coccyx is reduced from what would be encountered with a cushion having uniform thickness throughout. In all other respects this form of the invention is constructed and functions the same as that previously described.

The cushion in both forms of the invention can be constructed so that either side can be oriented upwardly, and the lengths of tubing can be positioned to extend toward a desired side of the chair or other seat apparatus.

In operation, all chambers are initially inflated. Chambers 1 and 2 are then deflated for a predetermined interval of time and then reinflated. Chambers 3 and 8 are next deflated for a predetermined time interval and then reinflated, followed by deflation and reinflation of chambers 4 and 7, then chambers 5 and 6, and then back to chambers 1 and 2. Other sequences could be employed to temporarily relieve pressure on different areas of the face. For example, chambers 1 and 5 could be deflated and then reinflated, followed by chambers 2 and 6, then chambers 3 and 7, then chambers 4 and 8, and then repeating the sequence. Or, the sequence of deflation and reinflation could comprise chambers 1 and 3, followed by chambers 2 and 8, then chambers 4 and 7, then chamber 6; or, chambers 2 and 7, followed by chambers 8 and 3, then chambers 1 and 5, then chamber 6; etc. Temporary relief of pressure on each area of the buttocks supported by the cushion, while preserving balance and stability of the person, is more important than the particular sequence employed. In this regard, reinflation of deflated chambers can begin while deflation of the next pair of chambers is commencing, or more than one pair of chambers could be deflated at the same time, so long as the person remains supported by multiple chambers. For example, chambers 1 and 5 could be deflated at the same time that chambers 3 and 7 are deflated, etc. The timing of each sequence is about one minute, and no more than about two minutes.

Both forms of cushion have a forward edge 35, a rearward edge 36, and opposite side edges 37 and 38. The partitions that divide the chambers from one another extend radially from a central portion (the T-shaped opening in the first embodiment and the center of the cushion in the second embodiment) to an adjacent edge, whereby each chamber extends completely across the width of the body from the edge to the central portion.

The seat cushion of the invention provides secure and reliable support for a person remaining seated for prolong periods of time, affords great flexibility in its use, increases comfort to the person sitting on the cushion, and avoids the formation of pressure sores that are frequently caused by pressure exerted on the skin of a patient while the patient remains immobile during prolonged periods of time.

What is claimed is:

1. A seat cushion for supporting a person remaining in a sitting position for a prolonged period of time, comprising:

flexible sheets of material secured together to define a generally rectangularly shaped inflatable body having a forward edge, a rearward edge, opposite side edges, a recessed central portion, and a hollow interior, said body being incapable of supporting the weight of a person when the body is not inflated;

a plurality of partitions extending across the interior of the body in a direction from said central portion thereof to an adjacent edge, dividing the body into a plurality of individual generally pie-shaped chambers spaced sequentially around the body, with two chambers at each of the forward, rearward and side edges, and each chamber extending completely across the width of the body from an outer edge to the central portion thereof; and means connected with the chambers to sequentially inflate and deflate them in an alternating cyclic pattern so that some of the chambers are expanded to contact and support the buttocks of the person while other chambers are contracted to relieve the pressure exerted against the buttocks by said other chambers, each of said chambers being alternately inflated and deflated, whereby the formation of pressure sores and other deleterious effects are avoided by periodically and temporarily relieving pressure exerted by each of the chambers against respective different areas of the buttocks, and at least one chamber at each of the forward edge, rearward edge, and opposite side edges is inflated at all times to provide stable support to a person sitting on the cushion.

2. A seat cushion as claimed in claim 1, wherein:

the means connected with the chambers to sequentially inflate and deflate them comprise a source of pressurized fluid and valve means to connect the chambers alternately with said source and with exhaust.

3. A seat cushion as claimed in claim 2, wherein:

the pressurized fluid comprises a gas.

4. A seat cushion as claimed in claim 1, wherein:

at least one chamber on each side of the cushion is inflated at all times to provide balanced support to a person sitting on the cushion, said chambers being periodically temporarily deflated to relieve pressure on the areas of the buttocks supported by those chambers while other chambers are inflated to provide said support.

5. A seat cushion as claimed in claim 4, wherein:

the means connected with the chambers to sequentially expand and contract them comprise a source of pressurized fluid and valve means to connect the chambers alternately with said source and with exhaust.

6. A seat cushion as claimed in claim 5, wherein:

the pressurized fluid comprises a gas.

7. A seat cushion as claimed in claim 1, wherein:

said cushion is toroidally shaped, with said central portion comprising a generally T-shaped opening to provide clearance in the area underlying the coccyx of the person.

8. A seat cushion as claimed in claim 7, wherein:

there are eight chambers arranged sequentially in a clockwise direction around the torodially shaped cushion, at least two of said chambers that are in generally opposed relationship on opposite sides of the cushion being deflated and at least one chamber adjacent each of said two chambers being inflated at the same time, whereby pressure relief is afforded by the deflated chambers while support is provided by the inflated chambers.

9. A seat cushion as claimed in claim 8, wherein:

the means connected with the chambers to sequentially inflate and deflate them comprise a source of pressurized fluid and valve means to connect the chambers alternately with said source and with exhaust.

10. A seat cushion as claimed in claim 1, wherein:

said central portion of said cushion is recessed relative to a peripheral portion thereof, said recessed central portion having generally a U-shape.

11. A seat cushion as claimed in claim 10, wherein:

said partitions intersect at a common point generally centrally located in the cushion, whereby the chambers comprise generally pie-shaped or triangularly shaped segments extending around the interior of the cushion, with each chamber extending across a portion of the recessed central portion and a portion of the peripheral portion.

12. A seat cushion as claimed in claim 1, wherein:

there are eight chambers spaced sequentially around the cushion, and said chambers are sequentially and cyclically deflated and then reinflated in pairs, with each cycle of deflation spanning a predetermined time interval.

13. A seat cushion as claimed in claim 12, wherein:

the predetermined time interval comprises from about one to about two minutes.

14. A seat cushion as claimed in claim 1, wherein:

the cushion is supported in a wheelchair, and the means connected with the chambers to sequentially inflate and deflate them includes a power source for the wheelchair.

* * * * *